United States Patent [19]

Charland et al.

[11] 3,968,773

[45] July 13, 1976

[54] MAGNETIC BRUSH DEVELOPING APPARATUS

[75] Inventors: Terrence D. Charland, Pittsford; Stanley D. Klett, Fairport, both of N.Y.

[73] Assignee: Xerox Corporation, Stamford, Conn.

[22] Filed: Mar. 3, 1975

[21] Appl. No.: 554,954

Related U.S. Application Data

[60] Division of Ser. No. 442,036, Feb. 13, 1974, Pat. No. 3,906,898, which is a continuation-in-part of Ser. No. 255,721, May 22, 1972, abandoned.

[52] U.S. Cl. ..... 118/637

[51] Int. Cl.[2] ..... G03G 15/09

[58] Field of Search ..... 118/637; 427/21

[56] References Cited

UNITED STATES PATENTS

| | | | |
|---|---|---|---|
| 3,176,652 | 4/1965 | Mott et al. | 118/637 |
| 3,455,276 | 7/1969 | Anderson | 118/637 |
| 3,724,422 | 4/1973 | Latone et al. | 118/637 |

*Primary Examiner*—Morris Kaplan

[57] ABSTRACT

A magnetic brush developing apparatus as disclosed having magnetic rollers with end sleeves formed of an insulating material. A trimming bar is provided having a concave portion below a leading edge thereof to facilitate the return to the sump zone of excess developing material. Magnets disposed within the rollers are mounted on channel members in a manner to direct the magnetic forces about each brush to ensure blanket coverage and a downstream configuration to direct developing material over a baffle associated with a cross-mixing baffle assembly. A screen is provided within the housing of the assembly to collect foreign objects. A mixing and transport device is positioned within the sump zone and is comprised of a plurality of spaced-apart augurs disposed on a shaft and a plurality of radially-extending bars affixed to the ends of the augurs.

3 Claims, 10 Drawing Figures

MAGNETIC BRUSH DEVELOPING APPARATUS

This is a division of application Ser. No. 442,036 filed Feb. 13, 1974, now U.S. Pat. No. 3,906,989, which in turn is a continuation-in-part of application Ser. No. 225,721, filed May 22, 1972, now abandoned.

BACKGROUND OF THE INVENTION

This invention relates to improvements in developing apparatus for electrostatic printing machines, and more particularly, to improvements in a magnetic brush developing apparatus for accomplishing highly efficient, fast speed development of an electrostatically formed image.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to thereby discharge the charge in the areas where light strikes the layer. The undischarged areas of the layer thus form an electrostatic charge pattern in conformity with the configuration of the original pattern.

The latent electrostatic image may then be developed by contacting it with a finely divided electrostatically attractable material, such as a resinous powder. The powder is held in the image areas by the electrostatic fields on the layer. Where the field is greatest, the greatest amount of material is deposited; and where the field is least, little or no material is deposited. Thus, a powder image is produced in conformity with the image of the copy being reproduced. The powder is subsequently transferred to a sheet of paper or other transfer member and suitably affixed to thereby form a permanent print.

The latest concept for copiers utilizes high speed flash exposure of a document and the arrangement of a moving photoconductive material in the form of an endless belt which is continuously charged. Additionally, such copiers are provided with a developing system which supplies toner particles in relatively large quantities for solid area coverage, such as a magnetic brush developing apparatus.

The electrostatically attractable developing material commonly used in magnetic brush developing apparatus comprises a pigmented resinous powder referred to here as a "toner" and a "carrier" of larger granular beads formed with steel cores coated with a material removed in the triboelectric series from the toner so that a triboelectric charge is generated between the toner powder and the granular carrier. The magnetizable carrier also provides mechanical control for the formation of brush bristles by virtue of magnetic fields so that the toner can be readily handled and brought into contact with the exposed xerographic surface. The toner is then attracted to the electrostatic latent image from the carrier bristles to provide a visible powder image on an insulating surface of the photoconductive material. Generally, in an endless printing machine configuration which employs a plurality of magnetic brushes, the brushes are arranged for developing purpose with a run of the belt in the planar orientation.

In copending application Ser. No. 97,856, now U.S. Pat. No. 3,724,422, issued on Apr. 3, 1973 to Salvatore Latone and Michael R. Stanley, entitled "Magnetic Brush Developing Apparatus", and assigned to the same assignee, there is described a magnetic brush developing assembly comprised of a plurality of magnetic brushes having their axes arranged in parallel and in a plane generally parallel to the inclined plane of the photoreceptor belt at the zone of development therefor. The brushes are arranged so that the developing material in bristle form is moved in the inclined plane, whereupon, after moving past the last brush in the string of brushes, the material is returned for reuse to the sump at the beginning end of the string by gravity forces.

In order to improve homogeneity of the developing mixture and prevent toner particle depletion in any zone of the apparatus, a cross-mixing baffle assembly is provided, such as described in copending application Ser. No. 97,688, now U.S. Pat. No. 3,697,050, issued on Oct. 10, 1972 to Michael R. Stanley, entitled "Cross-Mixing Baffle", and assigned to the same assignee. In the lower portion of the sump of the developing apparatus, a paddle wheel impeller is provided to transport developing material towards the area adjacent the first magnetic brush of the magnetic brush developing apparatus.

In the magnetic brush developing apparatus heretofore used, arcing at various locations occurred which constituted a potential hazardous situation, as well as to effect the charge on the photoconductive surface thereby effecting the quality of the resulting image on a transfer member. Additionally, the developing material in the sump zone has suffered from lack of homogeneity, especially when a plurality of copies are being produced having large selected portions of solid area coverage. The relative positioning of the magnets within the rollers of the magnetic brush developing apparatus has resulted in the piling-up of developing material in undesirable locations within the housing with concomitant excessive clean-up requirements. Still further, caking of developing materials has occured about the trimming bar configurations heretofore employed.

OBJECTS OF THE INVENTION

An object of this invention is to provide an improved magnetic brush developing apparatus.

Another object of this invention is to provide an improved magnetic brush developing apparatus wherein arcing is minimized thereby eliminating the necessity of insulating the magnetic brush developing apparatus from the frame of the electrostatic copier machine.

Still another object of the invention is to provide an improved magnetic brush developing apparatus having an improved mixing and transport device in the sump zone to improve the homogeneity of the development material.

A further object of the invention is to provide an improved magnetic brush developing apparatus having an improved trim bar to minimize caking about the area of formation of the magnetic brush.

A still further object of the invention is to provide an improved magnetic brush developing apparatus wherein the quantity of toner added to the developing material is more efficaciously monitored.

Still another object of the invention is to provide an improved magnetic brush developing apparatus including means for removing foreign objects inadvertently introduced with make-up toner which could deleteriously effect operation of the machine as well as the machine, per se.

SUMMARY OF THE INVENTION

These and other objects of the invention are obtained in a magnetic brush developing apparatus by providing magnetic rollers therefor having end sleeves formed of an insulating material, such as Teflon (a trademark of DuPont), and wherein the drive sprocket for such rollers are formed from an insulating material, such as Nylon (a trademark of DuPont). A trimming bar is provided having a lead edge for trimming the bristles forming on the proximate brush of the magnetic brush developing assembly and having a concave portion below such leading edge to facilitate the return to the sump zone of development material removed by the trimming bar. The trimming bar is mounted in an insulating holder formed of a material, such as polypropylene, which holder is affixed to the housing of the magnetic brush developing apparatus, as more fully hereinafter discussed.

The magnets disposed within the rollers of the apparatus, such as described in copending application Ser. No. 220,965, now U.S. Pat. No. 3,823,688, issued on July 16, 1964 to Stanley Klett, entitled "Magnetic Brush Assembly", assigned to the same assignee, are mounted on channel members in a manner to direct the magnetic forces about each brush to insure blanket coverage and a downstream configuration to direct more efficaciously the development material over a baffle associated with the hereinbefore mentioned cross-mixing baffle assembly. A screen is disposed beneath the discharge conduits of the cross-mixing baffle to collect foreign objects which may be readily removed during any turn-around period of the machine. A mixing and transport device is positioned within the sump zone of the apparatus and is comprised of a plurality of spaced apart augurs disposed on a shaft and a plurality of radially extending bars affixed to the ends of the augurs to improve the homogeneity of developing material.

DESCRIPTION OF THE DRAWINGS

A better understanding of the present invention as well as other objects and further features thereof will become apparent upon consideration of the following detailed disclosure thereof, especially when taken with the accompanying drawings, wherein like numerals designate like parts throughout.

Figure 1:
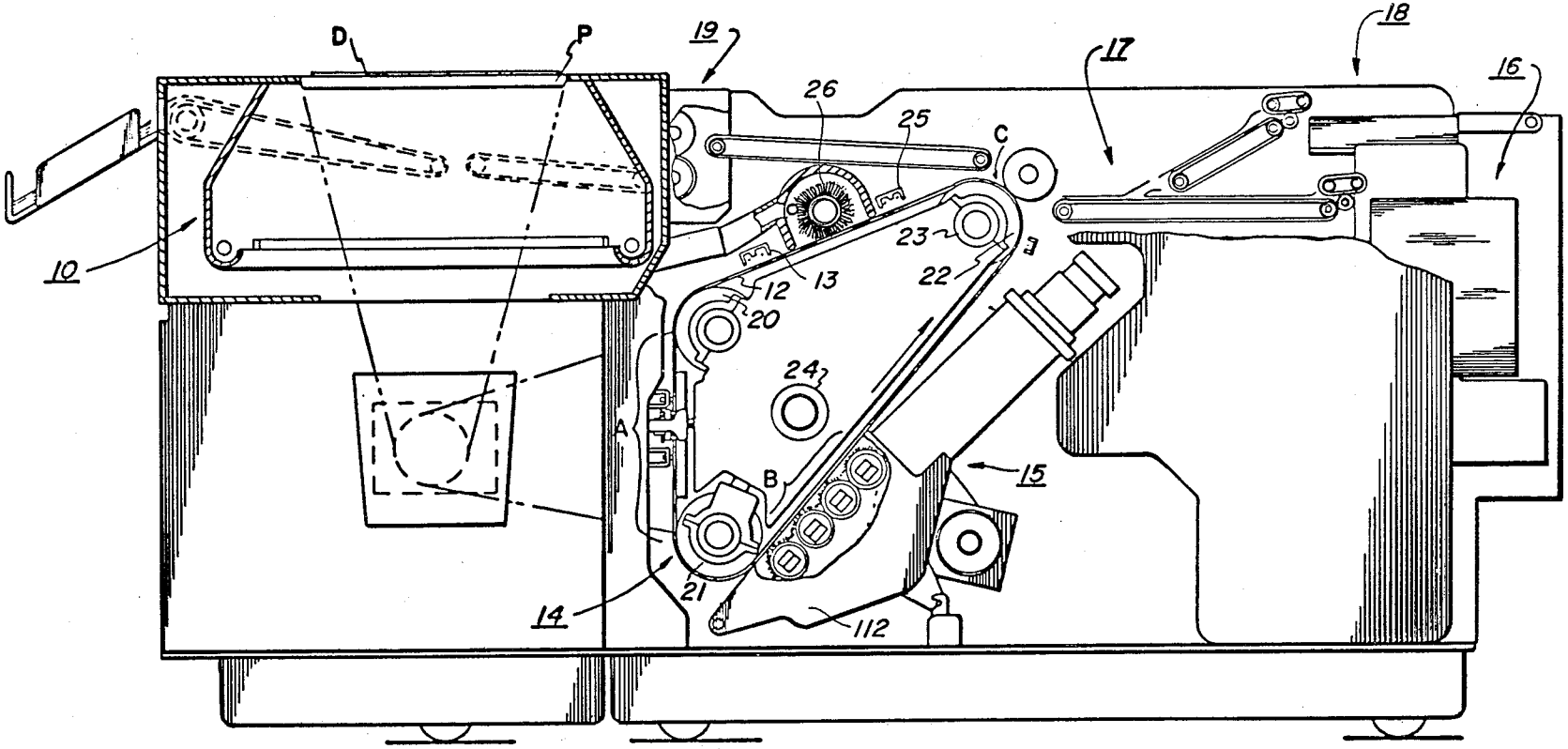
FIG. 1 is a schematic sectional view of an electrostatic reproduction machine embodying the principles of the invention.

For a general understanding of the illustrated copier/reproduction machine in which the invention may be incorporated, reference is had to FIG. 1 in which the various system components for the machine are schematically illustrated.

A document D to be copied is placed upon a transparent support platen P fixedly arranged in an illumination assembly, generally indicated by the reference numeral 10, positioned at the left end of the machine. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24, with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During such movement of the belt 12, the reflected light image of such original document positioned on the platen is flashed on the surface of belt to produce an electrostatic latent image thereon at exposure station A.

As the belt surface continues its movement, the electrostatic image passes through a developing station B in which there is positioned a magnetic brush developing apparatus, generally indicated by the reference numeral 15, and which provides development of the electrostatic image by means of multiple brushes as the same moves through the development zone, as more fully hereinafter described.

The developed electrostatic image is transported by the belt to a transfer station C whereat a sheet of copy paper of transfer member is moved between a transfer roller and the belt at a speed in synchronizm with the moving belt in order to accomplish tranfer of the developed image solely by an electrical bias on the transfer roller. There is provided at this station a sheet transport mechanism, generally indicated at 17, adapted to transport sheets of paper from a paper handling mechanism, generally indicated by the reference numeral 18, to the developed image on the belt at the station C.

After the sheet is stripped from the belt 12, it is conveyed into a fuser assembly, generally indicated by the reference numeral 19, wherein the developed and transferred xerographic powder image on the sheet material is permanently affixed thereto. After fusing, the finished copy is discharged from the apparatus at a suitable point for collection externally of the apparatus. The toner particles remaining as residue on the developed image, background particles and those particles otherwise not transferred are carried by the belt 12 to a cleaning apparatus 26 positioned on the rim of the belt between rollers 20 and 22 adjacent a charge device 25. Further details regarding the structure of the belt assembly 14 and its relationship with the machine and support therefor may be found in the copending application Ser. No. 102,312, assigned to the same assignee, now U.S. Pat. No. 3,730,623, issued on Jan. 5, 1973.

Figure 3:
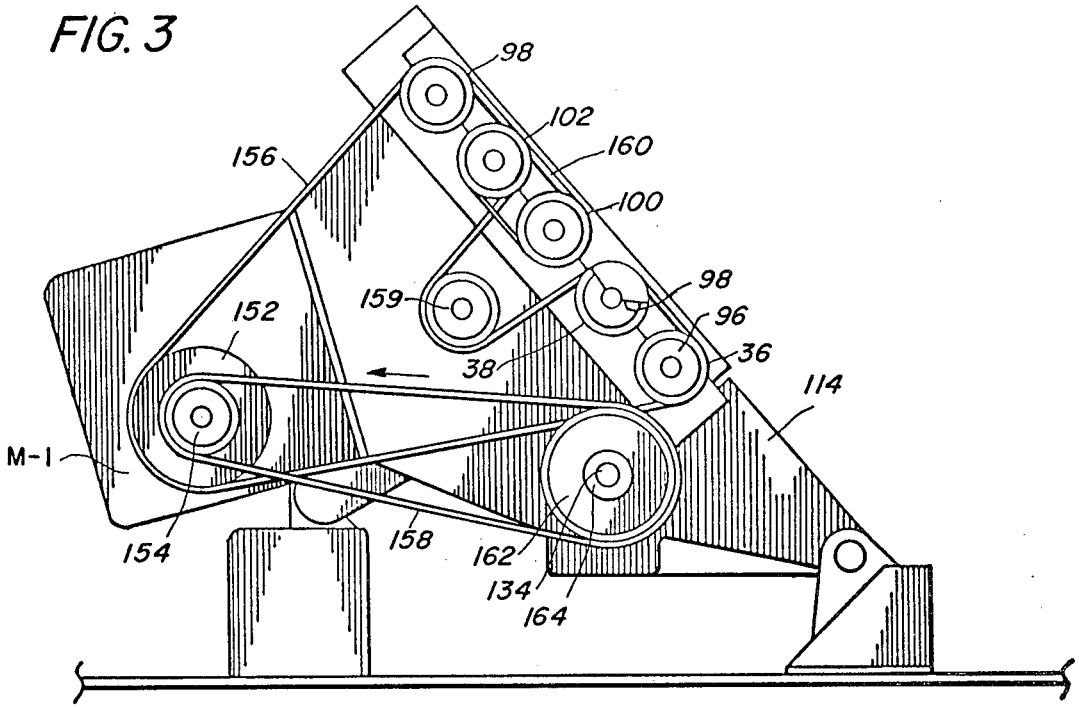
FIG. 3 is an elevational view of the other side of the magnetic brush developing assembly shown in FIG. 2 and illustrating the drive mechanism for the magnetic brush roller apparatus.
Figure 4:
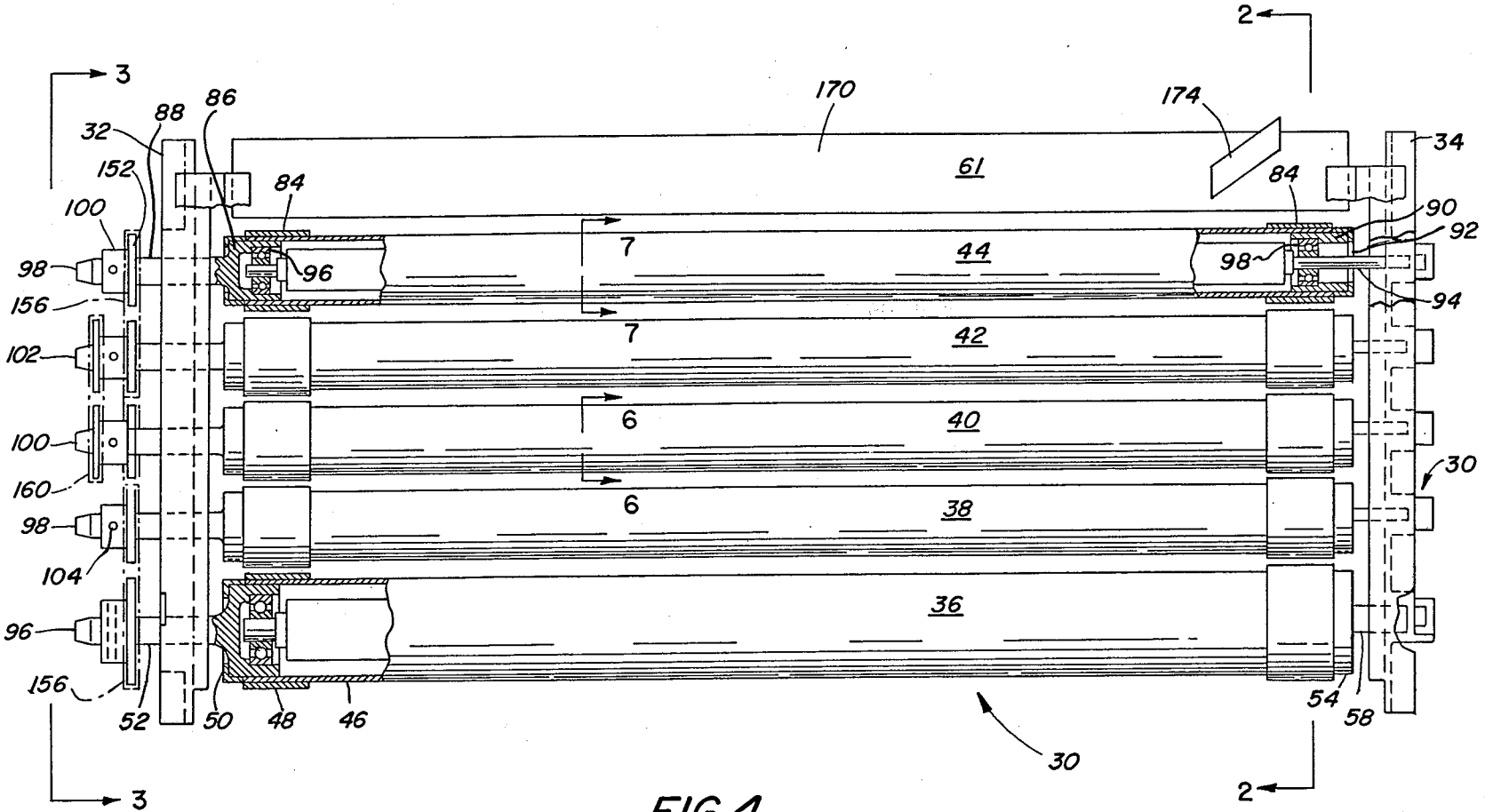
FIG. 4 is a top plane view of the roller assembly for a magnetic brush developing apparatus.
Figure 5:
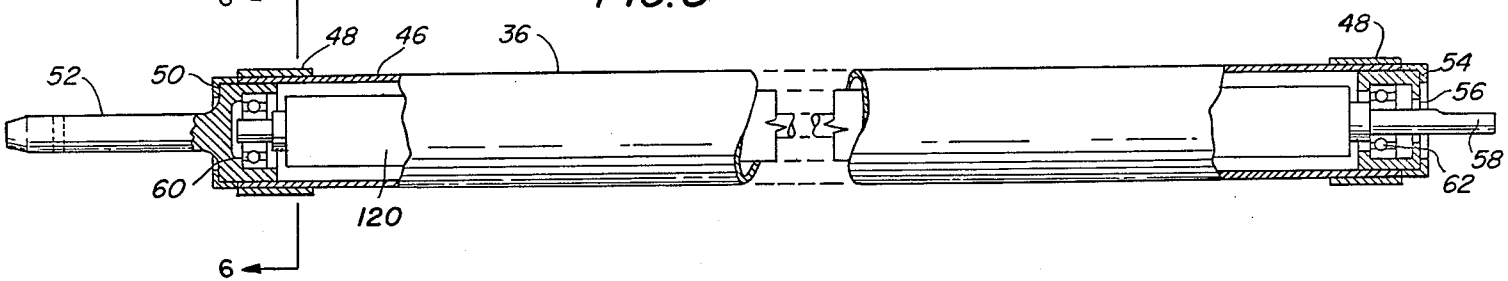
FIG. 5 is a partial sectional view of the proximate roller of the roller apparatus.

Referring first to FIGS. 2 to 5, particularly FIGS. 4 and 5, there is illustrated a roller assembly, generally indicated as 30, comprised of end plates 32 and 34 which receive rollers 36, 38, 40, 42 and 44 and provided with a plurality of holes (not shown) for mounting the roller assembly 30 within the magnetic brush developing apparatus 15 of the machine.

The roller 36 is comprised of a cylindrical sleeve 46 of a roughened surface formed of a non-magnetizable material and extending almost the length of the housing of the developing apparatus 15. End sleeves 48, formed of an insulating material, such as Teflon (a trademark of DuPont), are suitably disposed on the cylindrical sleeve 46 such as by a heat treatment whereby the sleeves 48 shrink about the ends of the roller 36. One end of the sleeve 46 is closed by a cap 50 which supports a drive shaft 52 in coaxial alignment with the sleeve 46. The other end of the sleeve 46 is closed by a cap 54 having an orifice 56 through which extends a shaft 58. Suitable bearing means 60 and 62 are provided on the shaft 58 which cooperates with inner bearing surfaces formed in the end caps 50 and 54, respectively, to permit the sleeve 48 to rotate about shaft 58. Within the sleeve 46, there are positioned elongated bar magnets 120, 122 (see FIG. 2), as more fully hereinafter discussed, extending nearly the full length of the sleeve 46 and suitably affixed to the shaft 58, such as by welding.

Rollers 38, 40, 42 and 44 are comprised of cylindrical sleeves 82 of a roughened surface formed of non-magnetizable material and co-extensive with sleeve 46 of the roller 36, and are provided with end sleeve 84, similar to the end sleeves 48 of roller 56. One end of the sleeve 82 is closed by a cap 86 which supports a drive shaft 88. The other end of the sleeve 82 is closed by a cap 90 having an orifice 92 through which extends a shaft 94. Suitable bearing means 96 and 98 are provided on the shaft 94 which cooperate with inner bearing surfaces formed in caps 86 and 90, respectively, to permit the sleeve 82 to rotate about the shaft 94. Within the sleeve 82 there is positioned an elongated bar magnet 126, as more fully hereinafter described, extending nearly the full length of the sleeve 82 and suitably affixed to the shaft 94.

The drive shafts 52, 88 of the rollers 36, 38, 40, 42 and 44 are suitably mounted in bearings in end plate 32. The ends of the drive shafts 52 and 88 of the roller 36 and, the rollers 38 and 44, the respectively, extending beyond the end plate 32 are provided with sprockets 96 and 98 respectively. The drive shafts 88 for rollers 40, 42 are provided with sprockets 100, 102 respectively. Sprockets 96, 98, 100, 102 are suitably affixed to their respective drive shaft, such as by pins 104. The sprockets are formed of an insulating material, such as Nylon (a trademark of DuPont).

Figure 2:
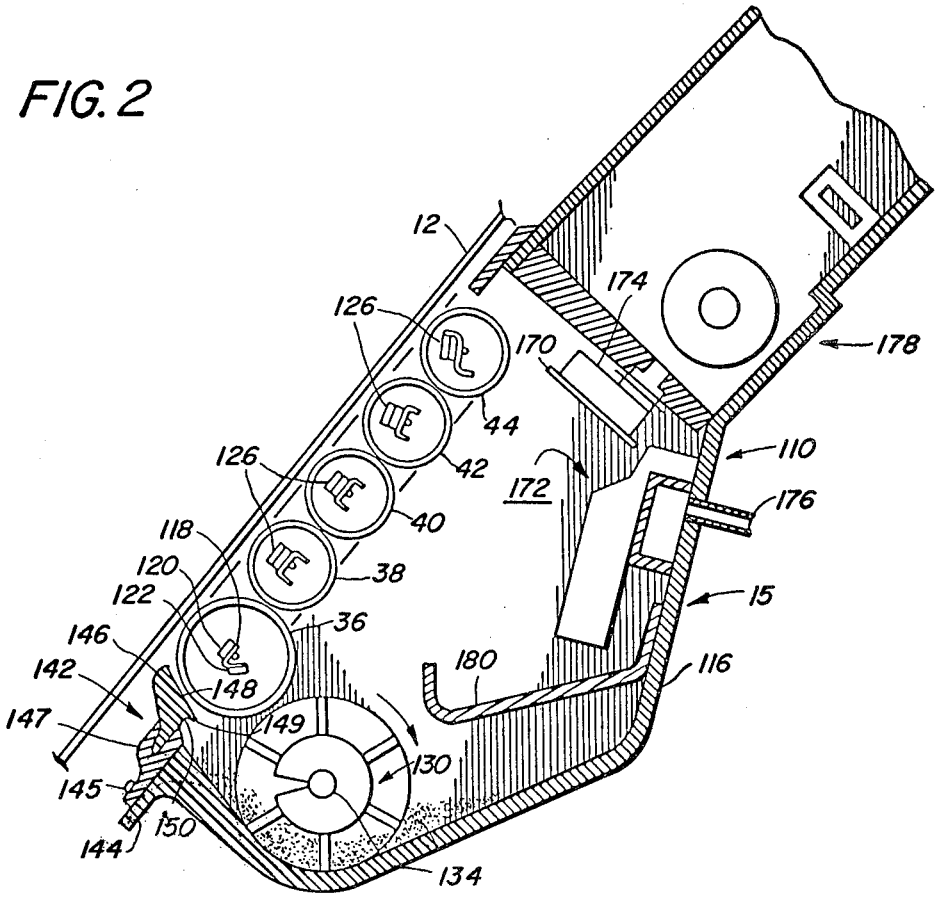
FIG. 2 is a partial sectional view of the magnetic brush developing apparatus, in part, taken along the lines 2—2 of FIG. 4.

Referring specifically to FIGS. 2 and 3, the magnet roller assembly 30 is disposed within the magnetic brush developing assembly 15 comprised of a housing, generally indicated as 110, having a generally rectangular cross section and a length extending beyond the width of the photoconductive belt 12. The housing 110 is substantially closed except for an opening adjacent the photoconductive belt 12 whereat development of the latent image is effected. The housing 110 serves as a container, closed at its sides, by end walls 112 and 114 and supporting an inclined bottom wall 116 for containing developing material comprising carrier beads from magnetizable material and colored electrostatic toner particles which adhere thereto.

As hereinabove discussed, the magnetic rollers 36, 38, 40, 42 and 44 are mounted for rotation within the housing 110 with their axes parallel and below the selenium belt 12. Within sleeve 46 of roller 36, there is provided an angle bar 118 extending nearly the full length of the sleeve 46 on which are mounted elongated bar magnets 120 and 122 with the front surface of bar magnet 120 being substantially parallel to the belt 12. The bar magnet 122 provides a means for transporting developing material from the lower sump portion of the housing 116 adjacent the periphery of sleeve 46 of the roller 36.

Figure 7:
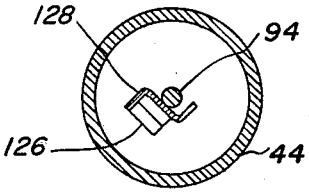
FIG. 7 is an enlarged cross-sectional view of the ultimate roller of the magnetic brush roller apparatus taken along the lines 7—7 of FIG. 4.
Figure 6:
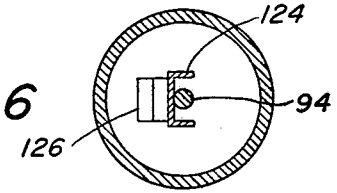
FIG. 6 is a cross-sectional view of an intermediate roller taken along the lines 6—6 of FIG. 4.

Within each sleeve 82 of the rollers 38, 40 and 42, a U-shaped channel member 124 is mounted on each of the shafts 58 extending nearly the full length of the sleeves with elongated bar magnets 126 being affixed to the outer surface of the innerly member extending between the outer legs of the U-shaped channel member 124 (see FIG. 6). The surface of bar magnets 126 of rollers 38 and 40 are substantially parallel to the surface of the photoconductive belt 12. The surface of bar magnet 126 of sleeve 42 is disposed at an angle of about 15° with the plane of the surface of the belt 12. As seen in FIG. 7, the roller 44 is provided with a generally S-shaped support member 128 mounted on the shaft 94 and extending nearly the full length of the sleeve 82. An elongated bar magnet 126 is mounted on the middle portion thereof with the surface of the magnet 126 being disposed at an angle of about 30° with the plane of the surface of the belt 12.

As shown in FIGS. 2 and 4, the peripheral walls of the roller 36 and those for the other rollers are relatively close to each other. During a development cycle when all rollers are rotating in unison in the same direction and with their respective magnetic bars held stationary, the brush bristles produced by the influence of the magnetic field emanating from the bar magnets acting upon the magnetizable carrier beads in the developing material will form on the upper region of the sleeve 36 between this cylinder and the undersurface of the selenium belt 12. Bristles remain formed during the developing cycle, being initiated by the influence of the bar magnet 122 disposed within sleeve 46 of the roller 36, and being maintained during rotation of the sleeve 46 by the magnetic field of the magnet 120. When the bristles are moved out of the influence of the magnet 120 of the roller 36 beyond the closest distance between the belt 12 and the sleeve 46 thereof, bristle formation is maintained by the influence of the magnetic field for the magnet 126 associated with the sleeve 82 of the roller 38, which influence is stronger at this point than the diminished strength of the magnetic field attributed to the magnets 120 and 122 of the roller 36. This phenomenon is repeated until the last roller 44 is reached whereupon the developing material is eventually returned to the sump zone via the hereinabove mentioned chute assembly.

During movement of the carrier beads and toner through the development zone B, the magnetic bristles and, therefore, the development material, is in the form of a "magnetic blanket" extending continuously over all of the brushes of rollers 36, 38, 40, 42 and 44 for the entire width of the development zone B wherein the material is disposed or available to some degree for developing purposes. It will be apparent that the width of the development zone B is larger than the sum of the individual development zones for each of the magnetic brushes. Further details regarding the formation and effect of the "magnetic blanket" are described in the copending application Ser. No. 830,285, assigned to the same assignee, now U.S. Pat. No. 3,640,248, issued on Feb. 8, 1972.

The relative positioning of the bar magnet 126 mounted on U-shaped channel member 124 of roller 42 as well as the bar magnet 126 mounted on S-shaped member 128 of roller 44 results in a reduction of the magnetic flux thereabout to facilitate release of toner particles attached to the roller 44 to direct more accurately the toner depleted developing material to the hereinbefore described cross-mixing baffle assembly thereby minimizing build-up of developing material in undesirable locations which would necessitate frequent cleanup. In the absence of such configuration, the carrier particles have a tendency to adhere to the rollers and flow down the reverse side of the brush assembly 30.

Figure 8:
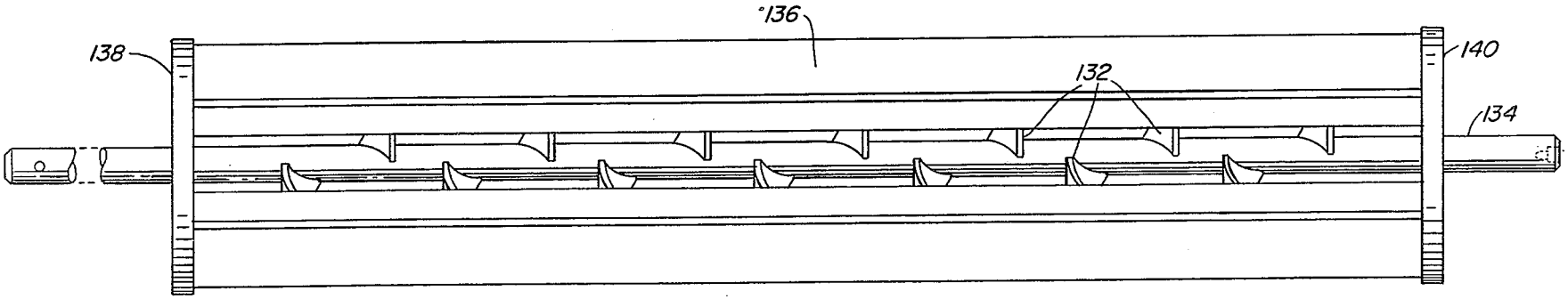
FIG. 8 is a front view of the mixing and transport device included in the magnetic brush developing apparatus.

Also mounted for rotation within the development housing 116 and below the magnetic roller assembly 30, there is provided a mixing and transport device, generally indicated as 130. Referring to FIG. 8, the mixing and transport device 130 is comprised of a plurality of spaced-apart augur elements 132 mounted on a drive shaft 134. A plurality of radially extending flat bars 136 are mounted to the outer extending surface portion of the augur elements 132. Cylindrically-shaped caps 138 and 140 are force fitted into the end portions of the bars 136. During a development cycle, the device 130 is caused to rotate in the direction shown by the arrow in FIG. 2 and serves to mix developing material within the zone defined by the augur elements 132 and to transport developing material by the flat bars 136 toward the pick-up zone adjacent the lower surface of the roller 36 independent of the state of levelness and the amount of carrier beads in the system. The development material in this vicinity is caused to be raised towards the roller 36 which will effect the formation of bristles on the sleeve 46 of the roller 36. As this sleeve 46 is caused to rotate, the newly formed bristles come under the influence of the magnet 120 and the "magnetic blanket" for the assembly 17 is initiated. It is noted that the augur elements 132 are disposed on the shaft 134 in a manner to permit localized intramixing of the developing material without conveying developing material from one end of the sump zone to another thereby minimizing localized concentration of developing material while enhancing homogeneity thereof.

In order to optimize the length of the bristles during the formation of the "magnetic blanket" upon the sleeves, there is associated with roller 36 a trimming blade assembly, generally indicated as 142, extending the width of the housing 116 and secured to a lower bottom wall portion 144 of the housing 116 such as by bolts 145. The trimming blade assembly 142 is comprised of a trimming blade 146 disposed within a mounting assembly 147 formed of an insulting material, such as a thermoplastic resin, and is provided with an upper flat surface 148 substantially tangential to the sleeve 36. The portion of the trimming blade 146 extending towards the mixing and transport device 130 is terminated in a knife edge 149 formed by the intersection of the flat surface 148 with a concave section 150 longitudinally formed in the trimming blade below the surface 148 thereof. Such configuration effectively determines the length of the bristles without the caking of developing material about the base thereof. The trimming blade 148 is spaced apart from the periphery of the roller 36 a short distance equal to the desired length of the bristles to be formed on the magnet brush assembly 30. It is noted that the trimming blade 146 does not directly contact the housing 116 but is insulated therefrom by the plastic mounting assembly 147.

The rotational motion for all of the rotary components of the developing apparatus 15, is illustrated in FIG. 3, and is derived from a motor M-1 and a drive system comprising, a sprocket 152 secured to a shaft of the motor, a smaller sprocket 154 also secured to the shaft, and timing chains 156 and 158 for connecting the sprockets 152 and 154, respectively, to the rotary components. Specifically, the chain 156 is drivingly engageable with suitable sprockets 96 and 98, mounted on the drive shafts 52, 88 of each of the rollers 36 and 38, respectively; an idler sprocket 158 formed of an insulating material, such as Nylon (a trademark of DuPont); and sprockets 102 and 98 secured to the drive shafts 88 of the rollers 42 and 44, respectively. A small chain 160 is provided to connect sprocket 100 of roller 40 with sprocket 102 of the roller 42 (see FIG. 4) thereby simultaneously driving roller 40 which is not directly connected to timing chain 156. With this arrangement, the magnetic brush rollers are rotated with the same peripheral speeds, in the same direction and in a direction which moves the "magnetic blanket" comprising magnetic brush bristles upwardly in an inclined plane arranged at the same angle as the angle of the plane of the belt in the development mode.

The timing belt 158 is connected to the drive sprocket 154 and with a driven sprocket 162 secured to the shaft 134 for the mixing and transport device 130 thereby to assure that the device 130 and the magnetic brush sleeves rotate in unison. The relative speed of the device 130 is slightly less than the peripheral speeds of the magnetic brush sleeve but is provided with a surface capacity which provides an excess of developing material being transported to the area about the sleeve 46 of the proximate roller 36.

The depleted developing material which is carried beyond the magnetic brush of roller 44 (the last brush in the series of magnetic brushes that comprise the developing device) is returned to the housing 110 in order to be re-used for development purposes. As the developing material is moved by the cylinder 44 away from the development zone B, it is directed by a longitudinal planar baffle plate 170 secured at its ends to the end walls 112 and 114 of the developer housing 116 to the upper end of a cross-mixing baffle assembly, generally indicated by the numeral 172. Another baffle plate 174 is mounted on the planar baffle plate 170 to direct representative portions of the depleted developing material through an automatic developer control, generally indicated as 176, to monitor effectively the rate of toner depletion and thereby appropriately add toner from a supply reservoir, generally indicated as 178, as warranted by the rate of toner depletion.

Disposed below the cross-mixing baffle assembly 172, there is provided a generally U-shaped screen 180 suitably mounted to the back wall 116 of the housing 110 and extending the width thereof. The lower leg of the screen is disposed within the housing 110 in a manner to classify and collect any foreign objects, such as paper clips and the like which may be inadvertently introduced into the toner supply reservoir 178.

While the description of the present invention has been directed to a magnetic brush apparatus having five rollers, it should be understood that less rollers, e.g., one roller, may be employed depending on the designed duty of the machine. Additionally, while the invention has been described with reference to a machine having an endless photoconductive belt assembly, it is understood that the principle of the invention is applicable to a machine employing a photoconductor drum wherein one or more rollers are provided in the magnetic brush assembly.

Figure 9:
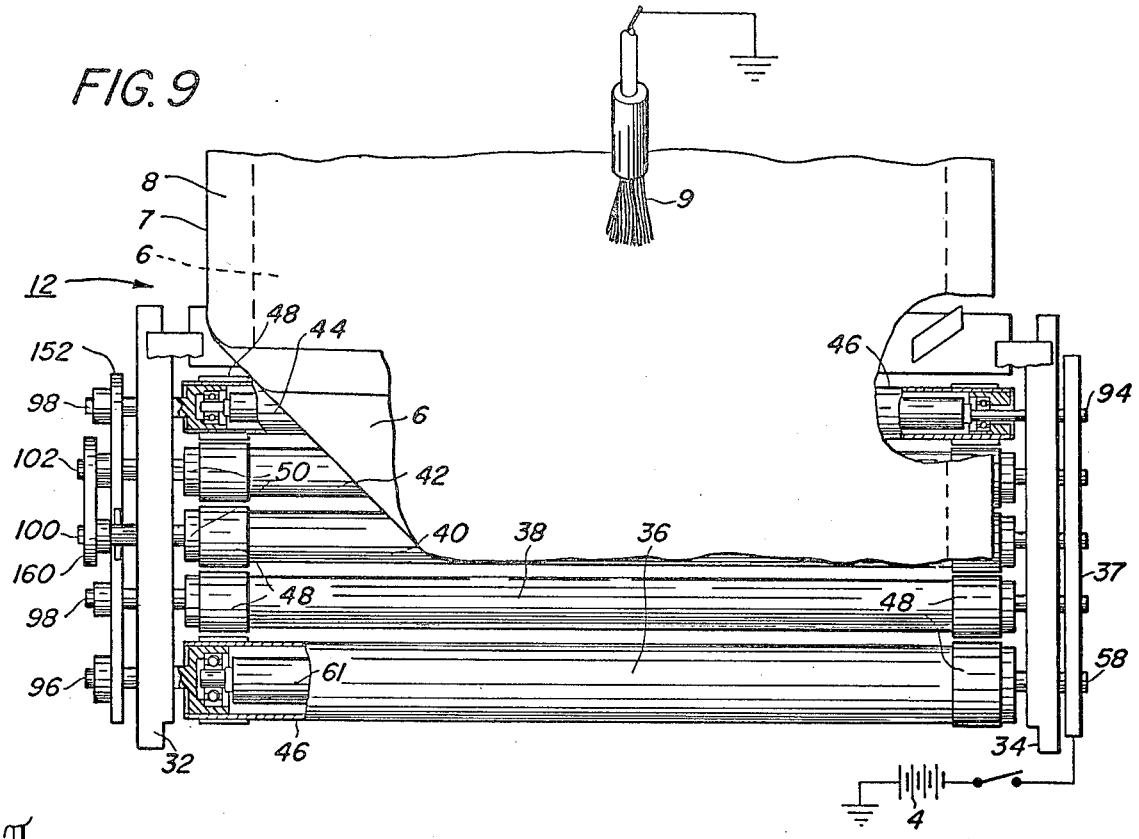
FIG. 9 is a top plane view of the magnetic brush roller assembly shown in FIG. 4, showing the relationship of the brush rollers to the reproduction machine photoconductive belt.

As best seen in FIG. 9, and as described heretofore, belt 12 comprises a photoconductive layer of selenium, designated by the numeral 6, on a conductive backing, designated by the numeral 7. Normally, the extent of the photoconductive layer 6 is somewhat less than the extent of the conductive backing 7 leaving a bare edge portion 8 along each side of the conductive backing 7. Conductive backing 7 is suitably grounded as by means of brush 9.

The before described magnetic brush developing assembly 30 has developing rollers 36, 38, 40, 42, and 44 thereof disposed substantially normal to belt 12, the rollers 36, 38, 40, 42, and 44 being of a length substantially equal to or slightly greater than the width of belt 12. The insulating end sleeves 48, 84 are disposed opposite the bare edge portions 8 to prevent shorting between the developing rollers 36, 38, 40, 42, and 44 and the conductive backing 7 of belt 12 as will appear.

In order to enhance development of the latent electrostatic images on belt 12, the sleeves 46, 82 of developing rollers 36 38, 40, 42, and 44 are biased to a pre-selected voltage level from a suitable voltage source, illustrated in exemplary fashion in FIG. 9 by battery 4. The bias is applied to rollers 36, 38, 40, 42, and 44 via a commutator bar 37 which is electrically connected to sleeve supporting shaft 58 of roller 36 and shafts 94 of rollers 38, 40, 42, and 44. The conductive path from the shafts 58, 94 may be traced through the sleeve bearing such as bearing 62 of developing roller 36 (see FIG. 5) to the sleeve itself. A typical biasing voltage is 400 volts.

To prevent shorting or grounding of the biased developing rollers 36, 38, 40, 42, and 44, with the adjoining components and parts, either directly, or through bridging circuits established through the semi-conductive carrier of the developing material, with possible deterioration in the quality of the image developed, certain of the operating components are fabricated from or supported through insulating materials as described earlier. More specifically, sleeves 48, 84 which are mounted on the terminal ends of developing rollers 36 and, 38, 40, 42, and 44 respectively, are comprised of an insulating material and are of a size and disposition to prevent conduction between the biased developing rollers 36, 38, 40, 42, and 44 and the bare side edges 8 of belt 12. Similarly, the mounting assembly 147 for trimming blade 146 is comprised of an insulating material to obviate shorting or grounding of the biased developing roller 36 via developing material trapped therebetween. In like manner, the drive sprockets 96, 98, 100, 102, 158 for developing rollers 36, 38, 40, 42, and 44 and the drive sprocket 162 for mixing and transport device 120 are formed from a suitable insulating material such as nylon to prevent shorting of the rollers 36, 38, 40, 42, and 44 through the drive mechanism or through transport device 130. And, the baffle plates 170, 174 are electrically isolated from the housing 116 to prevent shorting of developing roller 44.

The improved trimming blade assembly 142 which serves to optimize the length of the bristles during the formation of the "magnetic blanket" upon the sleeves of the developing rollers 36, 38, 40, 42, and 44 as described earlier, reduces the torque load placed upon motor M-1, driving both rollers 36, 38, 40, 42, and 44 and mixing and transport device 142. This reduction in the power required to drive the developing components in turn reduces the amount of heat generated, and hence the temperature to which the developing material is exposed to promote carrier life.

Figure 10:
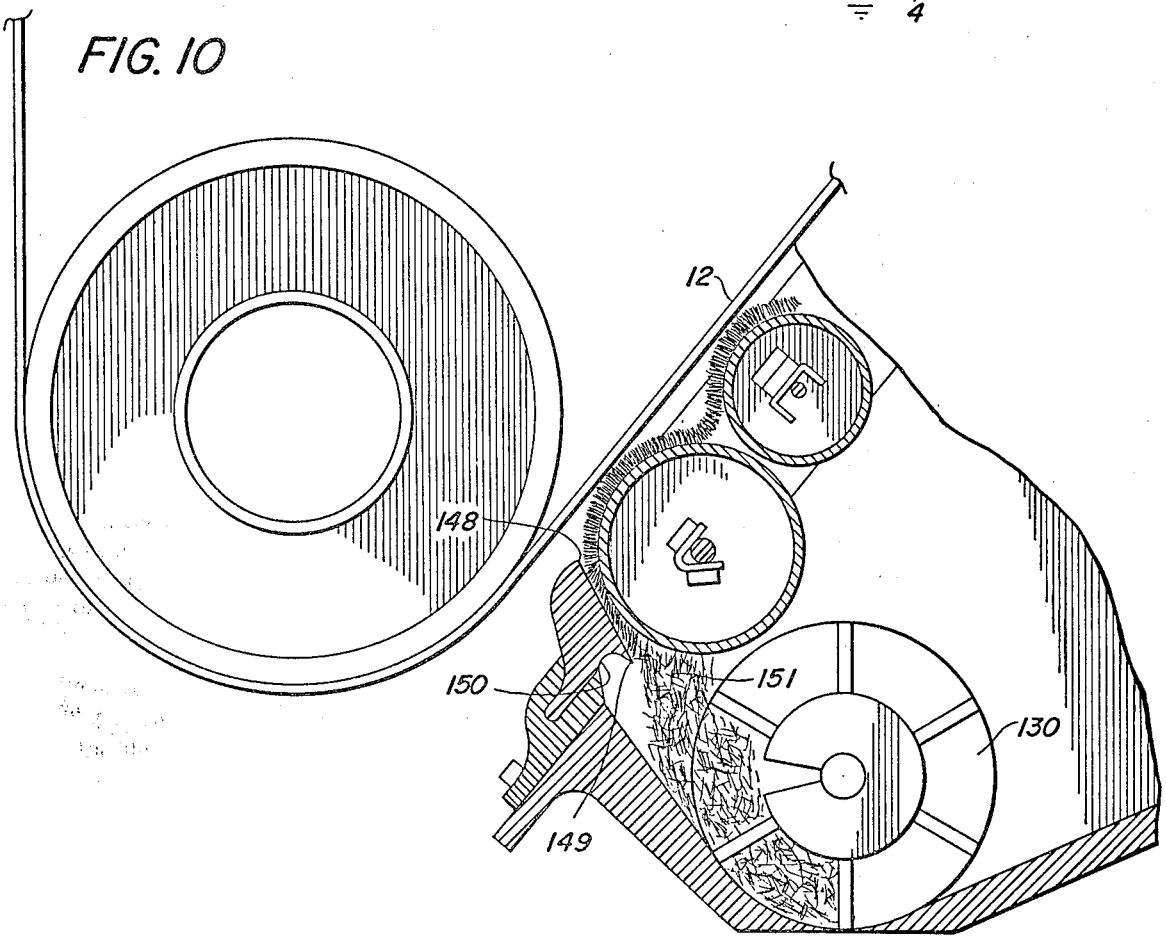
FIG. 10 is an enlarged sectional view of the developing apparauts trimming blade assembly.

As seen best in FIG. 10, excess developing material picked up by developing roller 36 is trimmed off by the leading edge 149 of trimming bar 148 to provide a preselected developing material blanket or pile height. As the developing roller 36 rotates, the blanket of developing material is drawn into the progressively decreasing throat or passage 151 formed between the surface 148 and the periphery of roller 36 to compact the developer blanket or pile prior to the developer blanket coming into operative disposition with belt 12. In this manner, the height of the developing material pile brought into operative relationship with belt 12 by developing roller 36 is controlled while at the same time a sufficient quantity of developing material is assured for the succeeding developing rollers 38, 40, 42, and 44.

While the instant invention as to its objects and advantages has been described herein as carried in specific embodiments thereof, it is not desired to be limited thereby; but it is intended to cover the invention broadly within the scope of the appended claims.

What is claimed is:

1. In a magnetic brush developing apparatus for applying developing materials to a photoconductive surface to develop electrostatic latent images thereon in an electrostatic printing machine, an improved roller assembly which comprises: an external sleeve, said sleeve being comprised of an electrically conductive material, and insulating members disposed on the end portions of said sleeve to electrically insulate said sleeve from external discharge.

2. The apparatus as defined in claim 1 including means to support said sleeve for rotation, a drive shaft for said sleeve, and insulated drive means affixed to said drive shaft for rotating said drive shaft and said sleeve while maintaining electrical insulation of said sleeve.

3. The apparatus as defined in claim 2 wherein the magnetic brush developing apparatus is comprised of at least two roller assemblies.

* * * * *